United States Patent [19]

Escales et al.

[11] 4,217,743

[45] Aug. 19, 1980

[54] APPARATUS FOR PROCESSING DEVELOPED PHOTOGRAPHIC FILMS AND PRINTS

[75] Inventors: Eberhard Escales, München; August Hell, Feldkirchen; Andreas Schubert, Munich; Klaus Weber, Leverkusen, all of Fed. Rep. of Germany

[73] Assignee: AGFA-Gevaert, A.G., Leverkusen, Fed. Rep. of Germany

[21] Appl. No.: 912,056

[22] Filed: Jun. 2, 1978

[30] Foreign Application Priority Data

Jun. 2, 1977 [DE] Fed. Rep. of Germany ..... 2724863

[51] Int. Cl.[2] ..... B65B 57/14; B65B 61/06

[52] U.S. Cl. ..... 53/54; 53/520; 53/131; 53/531; 53/386; 53/390

[58] Field of Search ..... 53/54, 520, 131, 571, 53/531, 386, 390

[56] References Cited

U.S. PATENT DOCUMENTS 3,789,571 2/1974 Tall et al. ..... 53/520 X 4,073,118 2/1978 Weber et al. ..... 53/520 X

*Primary Examiner*—Travis S. McGehee

*Attorney, Agent, or Firm*—Peter K. Kontler

[57] ABSTRACT

Assemblies of collated film sections and related prints, each belonging to a customer, are fed seriatim into a tray at the right-hand side of a horizontal table in front of a seated attendant so that the attendant can remove an assembly with the right hand while the left-hand opens the corresponding customer pocket which is held in a position of readiness at the left-hand side of the table. The attendant can observe the collating operation by inspecting successive film frames while the frames move above an illuminated window below and in front of the web of photographic paper with exposed and developed prints thereon. The pockets are removed seriatim from a magazine and are transported to the left-hand side of the table where the rear panel of an oncoming pocket is held by suction to facilitate the task of opening the pocket by pulling the front panel away from the rear panel.

16 Claims, 4 Drawing Figures

1
2
3
4
5
6
7
8
9
10
11
12
13
13
14
15
16
17
17a
18
19
20
21
105

APPARATUS FOR PROCESSING DEVELOPED PHOTOGRAPHIC FILMS AND PRINTS

BACKGROUND OF THE INVENTION

The present invention relates to improvements in apparatus for processing exposed and developed photographic customer films and other photosensitive material, especially portions (prints) of exposed and developed photographic paper which bear images of the film frames.

Processing apparatus for exposed and developed photographic films and corresponding (related) prints comprise a first severing unit which cuts successive customer films so that each film yields a group or set of sections having a length which is suitable for insertion into pockets bearing data identifying the respective customers and serving for shipment of completed orders to the customers or to the dealers who accept exposed but undeveloped photographic films from customers. Such apparatus further comprise a second severing unit which cuts a continuous web of exposed developed photosensitive material so that the web yields a succession of discrete prints. The first severing unit embodies a cutter which severs a film on detection of markers which are applied to the film to denote the frame lines between neighboring film frames, and the second severing unit also embodies a cutter actuated by a monitoring device which scans the web of photosensitive material for the presence of indicia denoting successive prints. It is also known to equip such processing apparatus with means for automatically delivering sections of customer films and stacks of related prints to a station where the film sections and the related prints are introduced into the aforementioned pockets which bear data identifying the customers as well as other data denoting the number and type of prints to be made and/or other information.

The output of recent types of film developing and copying machines is very high. Such machines operate automatically with a minimum of supervision. As a rule, a large number of discrete customer films will be spliced together to form an elongated web or strip which is transported through the developing machine and thereupon through the copying machine. During copying, the rear side of the web of photosensitive material onto which the images of film frames are exposed is normally provided with markers which identify successive prints and are monitored by the cutting device of the corresponding severing unit to insure that the web is cut at proper intervals so that each severed portion of the web constitutes a discrete print. The collating operation must be carried out in such a way that sections of a given customer film are invariably assembled with the corresponding (related) prints; this reduces the number of customer complaints and reduces the outlay for personnel in charge of detecting improperly collated prints and film sections. In other words, a pocket which is provided with data identifying a customer or dealer must receive film sections belonging to the customer who is identified on the pocket as well as the prints which bear images of the frames of such film sections.

In many presently known processing apparatus, a commercially available film cutter is mounted on a table or desk adjacent to a commercially available cutter for webs of photographic paper. The webs of photographic paper and the strips of film frames are advanced along horizontal paths to that portion of the table where the webs, the films and the paper are severed and where the severed material can be reached by an attendant who is in charge of introducing film sections and prints into the corresponding pockets. As a rule, the mounting of the cutting devices is such that an attendant grasps a set or group of film sections with one hand and a stack of prints with the other hand. These parts are then introduced into a pocket which is located on the table. The introduction into a pocket must be preceded by the transfer of film sections from the one hand into the other hand (which carries the prints), or vice versa, in order to enable the free hand of the attendant to grasp and open the corresponding pocket. Such transfer of film sections or prints takes up much time, especially when the attendant is to collate and pocket film sections and prints which issue from modern high-speed processing apparatus. Consequently, the cutters for films and for the webs of photosensitive material must be operated intermittently, i.e., they are set in motion only after the attendant completes a customer order by inserting the film sections and related prints into the corresponding pocket, by thereupon closing or sealing the pocket and by depositing the closed and/or sealed pocket into a tray or onto a conveyor for transport to a further station, e.g., to the shipping department.

Another drawback of the just described processing apparatus is that, though the locations where the sections of severed films and the corresponding prints accumulate on the table are readily accessible to the attendant, such person is not in a position to visually ascertain whether or not the prints and the film sections which are being introduced into a pocket actually belong to one and the same customer. It has been found that visual inspection of film frames and prints, at least at arbitrarily selected intervals, is likely to lead to rapid detection of improper operation of the severing units, i.e., such visual inspection enables the attendant to detect the assembly of prints with non-related film sections or vice versa at an early stage of malfunctioning of synchronizing means for the severing units so that the number of improperly assembled film sections and prints is relatively small. An experienced attendant can rapidly ascertain whether or not the prints of a given stack are actually related to the film sections which are about to be introduced into a customer pocket, together with the freshly assembled stack, because the attendant merely looks at the motif of one or more prints and of one or more frames of a film section and is then in a position to positively ascertain or to assume, with a high degree of probability, that the film sections are or are not related to the prints which, in the absence of inspection, would be introduced into one and the same pocket. Spot checking of prints and film sections is especially desirable when the processing apparatus is not equipped with automatic monitoring means for ascertaining whether or not the film sections and the prints are transported in synchronism with each other.

OBJECTS AND SUMMARY OF THE INVENTION

An object of the invention is to provide a novel and improved processing apparatus which enables an attendant to complete successive customer orders in rapid sequence and with a minimum of effort.

Another object of the invention is to provide a processing apparatus which enables an attendant to be comfortably seated while inserting film sections and related prints into pockets which are to be shipped or otherwise returned to customers, and which further enables such attendant to monitor, at regular or randomly selected intervals, the accuracy of operation of the collating means for assembly of film sections with related prints.

A further object of the invention is to provide a novel distribution of means for feeding empty pockets and assemblies of film sections and related prints to an attendant who is in charge of completing customer orders.

An additional object of the invention is to provide a processing apparatus which enables an attendant to complete at least ten customer orders per minute.

A further object of the invention is to provide an apparatus which is relatively simple and compact and which can employ several units and devices whose reliability, durability and accuracy has been ascertained during use in heretofore known processing apparatus.

A feature of the invention resides in the provision of an apparatus for processing webs of exposed and developed customer films and webs of exposed and developed photosensitive material including prints of the images of film frames of customer films. The apparatus comprises means for severing successive customer films so that each film yields a set of film sections (each section may consist of two or more coherent frames), means for severing the web of photosensitive material so that the latter yields discrete prints, means for collating sets of film sections and the related prints to form assemblies each of which includes a set of film sections and the prints bearing the images of frames of such film sections (the collating means includes means for delivering successive assemblies to a first location, e.g., into a tray at the right-hand side of a horizontal table in front of which the attendant is seated), a magazine for pockets bearing information which identifies the customer films, and means for transporting successive pockets from the magazine to a second location (e.g., to a filling station at the left-hand side of the aforementioned table). The first and second locations are respectively within reach of one hand and the other hand of the attendant who is in charge of introducing successively formed assemblies into pockets which are transported seriatim to the second location.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
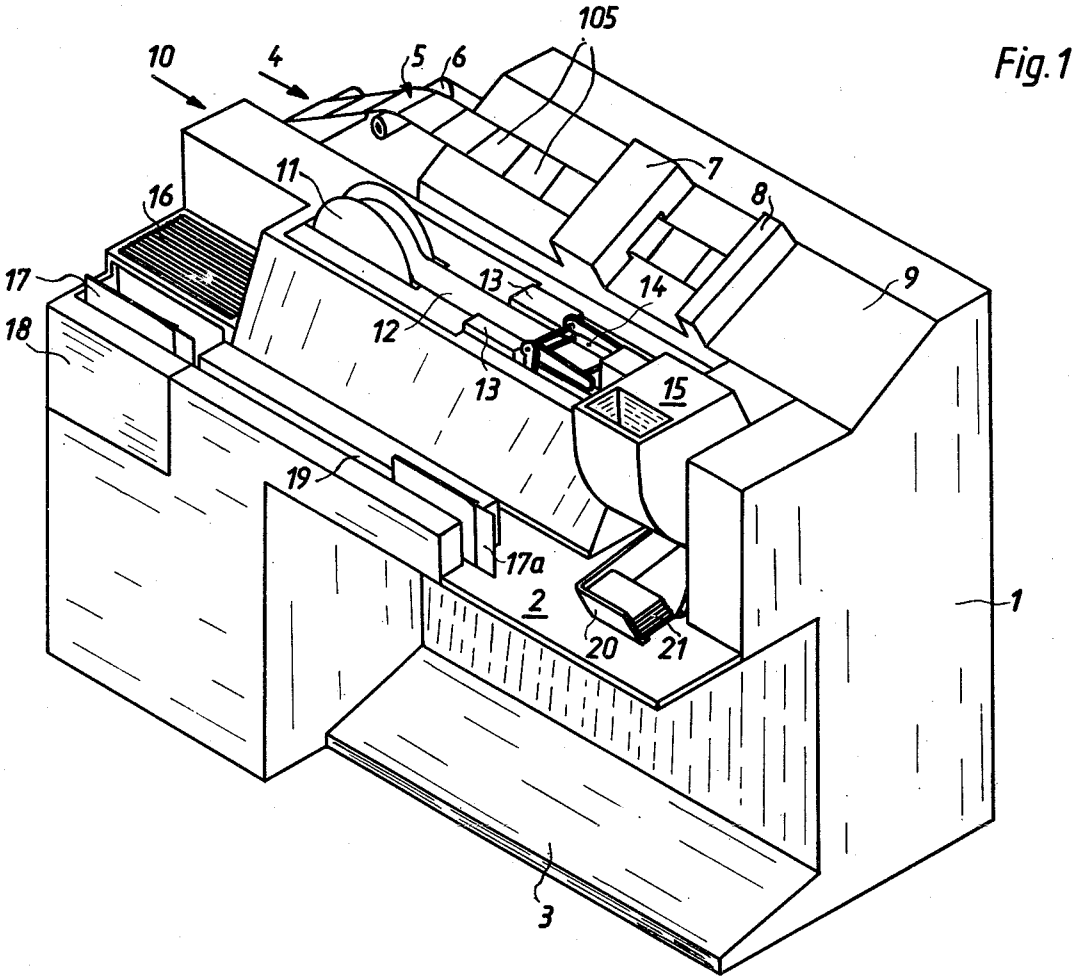
FIG. 1 is a perspective view of a processing apparatus which embodies the invention.

The processing apparatus of FIG. 1 comprises a housing 1 the front part of which includes a platform or table 2 disposed above a suitably inclined foot rest 3 for an attendant who is seated in front of the table 2. The rear portion of the housing 1 (i.e., that portion which is remote from and behind the table 2) supports and partially confines a first severing unit 4 for a web 5 of exposed and developed photosensitive material, such as photographic paper with coherent prints 105 of images of film frames. The web 5 is guided in such a way that it can advance transversely of the housing 1 and table 2, namely, from the left-hand side toward the right-hand side of the housing, as viewed in FIG. 1. The web 5 is withdrawn from a source of supply (e.g., a large reel, not shown) which is mounted at the rear side of the housing 1 and advances over a guide roller 6 toward and through a signal generating monitoring device 7 and thereupon into a cutting device 8 which severs the web 5 at intervals so that the latter yields a succession of discrete prints 105. The monitoring and cutting devices 7, 8 are installed on a forwardly and downwardly inclined supporting panel 9 of the housing 1 at a level above and behind the table 2. As shown, the web 5 is twisted during its travel between the guide roller 6 and the monitoring device 7 so that its plane is parallel to the plane of the exposed side of the panel 9 not later than upon its arrival at the monitoring station. Such manipulation of the web 5 ahead of the monitoring device 7 enables the attendant who is seated in front of the table 2 to conveniently observe the progress of prints 105 as well as the contents (motifs) of the prints 105 on their way toward the cutting device 8.

The housing 1 further supports and partly confines a film severing unit 10 which is disposed between the severing unit 4 and the table 2 and is located at a level below the unit 4. The path along which the web or strip 12 of spliced-together exposed and developed customer films is moved in a direction from the left to the right, as viewed in FIG. 1, is substantially parallel to the path of the web 5. The strip 12 is withdrawn from a supply reel 11 and advances between lateral guides 13 above an observation window 14 which is illuminated from below so that the attendant can examine the motifs and other characteristics of film frames. The leader of the strip 12 enters a cutting device 15 which is adjacent to a device 22 (shown in FIG. 2) wherein film sections belonging to a customer order are introduced into envelopes 32 for convenient introduction into pockets 17 which further receive stacks of corresponding (related) prints 105.

The housing 1 further supports a magazine 16 for a row of arrayed empty pockets 17. The pockets 17 are filed in the magazine 16 in the same sequence in which the corresponding customer films are spliced together to form the web or strip 12. Thus, the foremost pocket 17 in the magazine 16 contains information identifying the customer whose film is about to be severed in the cutting device 15 so that, when the sections of such film are accessible to the attendant, the attendant can also reach for the corresponding pocket 17 (in the position 17*a*) for introduction of the respective film sections into the interior of such pocket. The web or strip 12 is formed prior to transport of exposed customer films through a developing unit. Developed films are thereupon transported through a copying machine which makes reproductions of their frames onto the web 5.

The magazine 16 is mounted to the left of the table 2 and immediately behind a singularizing device 18 which removes successive foremost pockets 17 from the magazine 16 and places the thus withdrawn pockets 17 into the range of operation of a transporting device 19 for advancement of successive pockets 17 into immediate proximity of the left-hand side or onto the left-hand side of the table 2. The transporting device 19 advances the pockets 17 in a direction from the left to the right, as viewed in FIG. 1, so that the attendant can grasp the foremost pocket 17*a* with the left hand and can simultaneously grasp an assembly 21 of corresponding (related) film sections and prints 105 which are delivered to the table 2 (or onto the table) so that they come to rest in a container or tray 20 whose contents are accessible to the right hand of the attendant.

The attendant can remove the assembly 21 from the tray 20 with his or her right hand and can simultaneously open the foremost pocket 17*a* with his or her left hand to insert the assembly 21 into the interior of the opened pocket. The rear panel of the pocket 17*a* is attracted to the adjacent portion of the transporting device 19 or to the adjacent portion of the housing 1 while the attendant inserts the related assembly 21. The thus filled pocket 17*a* is then removed from the transporting device 19 and is closed or closed and sealed prior to depositing it into a receptacle (not shown) for completed customer orders. Owing to the novel distribution of various units and devices in and on the housing 1, the attendant can complete the filling, closing and deposition of a pocket 17 within approximately five seconds. During such interval, the apparatus processes the next customer order so that a fresh empty pocket 17 is ready for filling and the next assembly 21 is ready for removal from the tray 20 when the preceding customer order is completed. This insures that a single person can process a surprisingly large number of customer orders. Based on the aforementioned 5-second intervals for manual processing of discrete customer orders, an attendant can complete more than 700 customer orders per hour.

Figure 2:
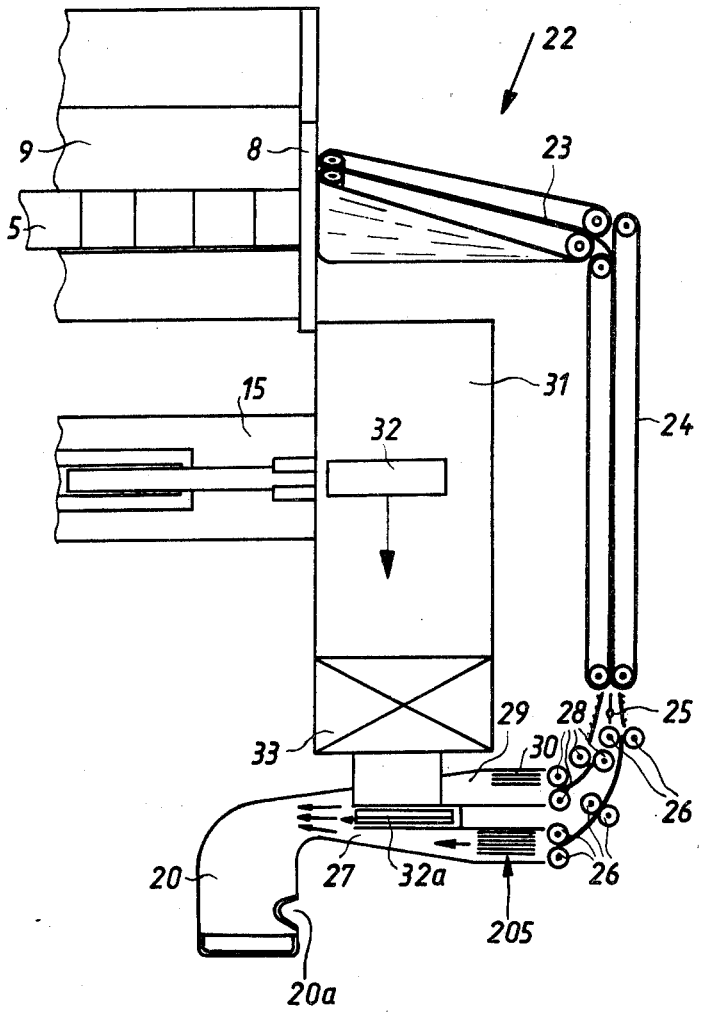
FIG. 2 is an enlarged plan view of the collating means in the apparatus of FIG. 1.

FIG. 2 shows a collating unit 22 which cooperates with the cutting devices 8 and 15 to make assemblies 21 which are delivered into the tray 20 on or adjacent to the right-hand portion of the table 2, as viewed in FIG. 1. Successive severed prints 105 enter between two endless belt conveyors 23 which are twisted so that the prints 105 which are transported therebetween change orientation from that in which they are parallel or nearly parallel to the exposed side of the panel 9 to that in which they are located in a vertical plane. The thus reoriented prints 105 enter the space between two belt conveyors 24 which transport the prints frontwardly in a direction toward the table 2. The discharge end of the conveyor system including the belt conveyors 24 is disposed upstream of a pivotable switching or classifying device 25 which segregates satisfactory prints 105 from unsatisfactory prints 30 in response to signals which are transmitted by the monitoring device 7. The device 25 is designed to divide the oncoming prints 105 into two groups, namely, into acceptable and unsatisfactory prints. However, it is equally within the purview of the invention to employ a classifying device which can divide oncoming prints into acceptable prints 105, unsatisfactory prints 30 and prints which must be replaced by fresh reproductions of corresponding film frames. Reference may be had to the commonly owned copending application Ser. No. 892,731 filed Apr. 3, 1978 by Weber et al, now U.S. Pat. No. 4,154,046.

The switch 25 directs satisfactory prints 105 into a first path which is defined by several pairs of rolls 26 and wherein satisfactory prints 105 advance into a channel or chute 27 which, in turn, delivers stacks of acceptable prints 105 into the tray 20. Unsatisfactory prints 30 are caused to advance along a second path which is defined by pairs of rolls 28, and such prints 30 accumulate in a receptacle 29.

The cutting device 15 of the film severing unit 10 is adjacent to an inserting device 31 which introduces sections of a customer film into an empty envelope 32, and the thus filled envelope 32 is thereupon delivered into the tray 20 to form part of an assembly 21 which is to be introduced, by hand, into the related pocket 17*a*. Empty envelopes 32 are stored in a hopper 33 and are fed to the inserting unit 31 where they assume positions ready for reception of sections of a customer film. Each section may consist of several neighboring film frames, e.g., a row of four, five or six coherent film frames. The cutting device 15 severs the customer films across frame lines between selected neighboring film frames, e.g., in a manner as disclosed in the aforementioned copending application Ser. No. 892,731 of Weber at al. Therefore, the drawing does not show each and every detail of the inserting device 31. Each filled envelope 32*a* is conveyed or admitted into the channel 27 and lands in the tray 20 next to the corresponding stack 205 of acceptable prints 105, i.e., the images of prints 105 in the stack 205 are reproductions of images of film frames in the adjacent envelope 32*a*.

FIG. 2 shows that a filled envelope 32*a* is admitted into the channel 27 between a stack of unsatisfactory prints 30 and a stack 205 of acceptable prints 105. It is clear that the apparatus can be designed to transport satisfactory prints 105, unacceptable prints 30 and filled envelopes 32*a* along three discrete paths whose discharge ends are located in or at the tray 20. The reference character 20*a* denotes a notch which is provided in the casing of the tray 20 to allow for convenient removal of an assembly 21, either with or independently of the stack of unacceptable prints 30.

Figure 3:
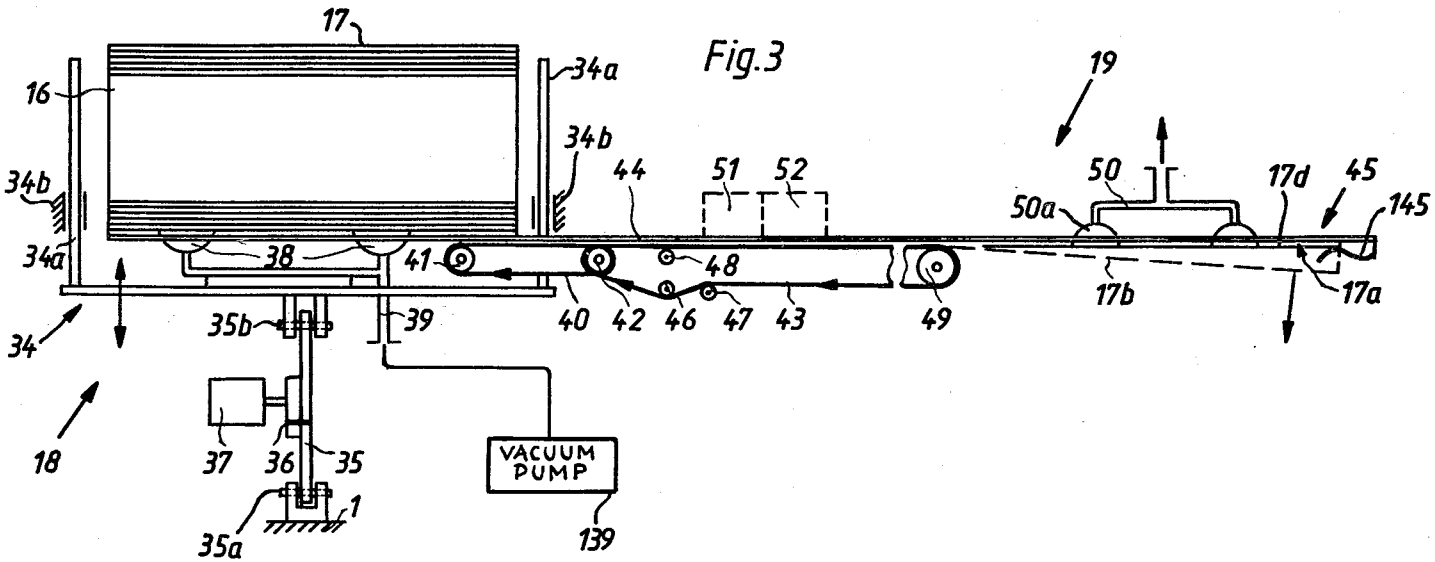
FIG. 3 is an enlarged plan view of the singularizing, transporting and opening devices for empty pockets.
Figure 4:
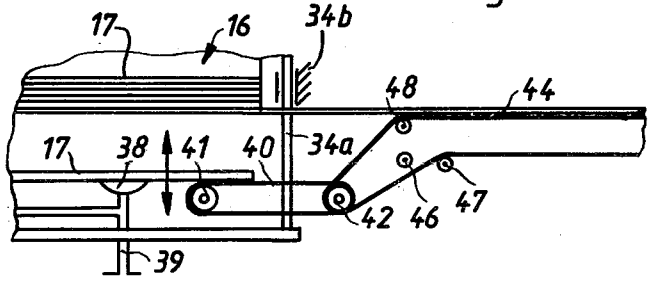
FIG. 4 shows the singularizing device of FIG. 3 upon completion of a singularizing step.

FIGS. 3 and 4 illustrate the details of the magazine 16, singularizing device 18 and transporting device 19 for discrete pockets 17. The singularizing device 18 is installed in front of the magazine 16; it comprises a reciprocable carriage 34 for one, two or more withdrawing elements in the form of suction heads 38 which can be moved toward the front panel of the foremost pocket 17 in the magazine 16 and are thereupon retracted (downwardly, as viewed in FIG. 3) to separate the foremost pocket 17 from the pocket therebehind. Parallel legs 34*a* of the carriage 34 are reciprocable in bearings 34*b* provided therefor in the housing 1 at both sides of the magazine 16. The means for reciprocating the carriage 34 between the two end positions which are shown in FIGS. 3 and 4 comprises a crank arm 35 one end portion of which is pivotally secured to the housing 1 and the other end portion of which is articulately connected with the carriage 34 (see the pivot members 35*a* and 35*b*). The crank arm 35 is pivoted by a motor 37 through the medium of a disk 36 which is rotated by an output element of a motor 37 and has an eccentric pin attached to the crank arm 35. The reference character 39 denotes a suction pipe (e.g., a flexible hose) which connects the suction heads 38 to a suitable suction generating device 139, e.g., a vacuum pump.

The carriage 34 further supports pulleys 41 and 42 for an endless belt conveyor 40 which is trained over the pulleys 41, 42 and is driven at requisite intervals in the direction indicated by arrow shown in FIG. 3. The belt conveyor 40 is mounted at that side of the carriage 34 which is adjacent to the transporting device 19. The latter comprises an endless belt conveyor 43 which is trained over fixedly mounted pulleys 46, 47, 48, 49 as well as over the pulley 42 on the carriage 34. A singularized pocket 17 which is withdrawn from the magazine 16 and is advanced by the belt conveyor 40 is engaged by the conveyor 43 and is transported along a stationary guide rail 44 toward a filling station 45 at the right-hand side of the table 2. It will be noted that the pocket-engaging reach of the conveyor 40 is coplanar with the open sides of the suction heads 38. The guide rail 44 extends from the right-hand side of the front part of the magazine 16 and all the way to the filling station 45. The pulley 49 is disposed at the filling station 45, and the pulleys 46, 47, 48 are mounted in such a way that the leftmost portion or end turn of the belt conveyor 43 can share the movements of the pulley 42 while the carriage 34 moves between the end positions of FIGS. 3 and 4. By being trained over a common pulley 42, the belt conveyors 40 and 43 can cooperate to advance a singularized pocket 17 from the range of suction heads 38 all the way to the filling station 45. A comparison of FIGS. 3 and 4 will indicate that the effective length of the belt conveyor 43 remains unchanged in each and every (end or intermediate) position of the carriage 34.

The filling station 45 accommodates a holding or retaining device including two or more suction heads 50*a* which are connected to the suction generating device 139 (or to a discrete suction generating device) by pipes 50. The suction heads 50*a* engage and attract the rear panel 17*d* of the pocket 17*a*. Such pocket is arrested by a suitable braking device 145, i.e., a leaf spring, which is adjacent to the path of movement of pockets 17*a* along the front side of the guide rail 44. The pocket 17*a* is located in a substantially vertical plane and the right-hand end portion of its front panel 17*b* extends beyond the right-hand end portion of its rear panel 17*d* so that the attendant can readily open the pocket 17*a* with his or her left hand preparatory to insertion of an assembly 21. The right-hand end portion of the front panel 17*b* of the pocket 17*a* can constitute a flap which is thereupon folded over the right-hand portion of the rear panel 17*d* to close the filled pocket 17*a* preparatory to deposition into a receptacle for completed customer orders. The means for timing the connection and sealing of suction heads 38, 50*a* from the respective suction generating device 13*a* or devices in response to signals from the monitoring device 7 is not specifically shown in the drawing. Thus, the suction heads 38 can be disconnected from the suction generating device 139 when the carriage 34 reaches the end position of FIG. 4, and the suction heads 50*a* can be disconnected from the respective suction generating device with a predetermined delay after arrival of a singularized pocket 17 at the filling station 45. The signals which are transmitted by the monitoring device 7 further serve to actuate the motor 37, the drive means for the conveyors 40, 43 and certain other mobile parts of the apparatus. Reference may be had to the commonly owned copending application Ser. No. 804,393 filed June 7, 1977 by August Hell et al, now U.S. Pat. No. 4,115,981.

The apparatus can further comprise a reader 51 of information which is encoded on the pockets 17 and/or a printing or labelling device 52 which is also adjacent to the path of movement of pockets 17 from the magazine 16 to the filling station 45. The reader 51 serves to compare the information which is encoded on successive pockets 17 with information which is encoded on the films whose sections are about to be introduced into such pockets 17. In the absence of identity of encoded information, the reader 51 furnishes a signal to inform the attendant that the pocket 17 which moves toward the position 17*a* is supposed to receive another customer's film sections.

The printer 52 can apply to pockets 17 information denoting the number of satisfactory prints 105 which are to be inserted at the filling station 45, the overall cost of the order including the development and making of prints, if any, and/or other information. As mentioned above, the printer 52 can be replaced with or may form part of a labelling device which applies adhesive-coated labels (each of which carries information denoting the number of satisfactory prints, the cost of the customer order, etc.) to successive pockets 17.

When the motor 37 for the carriage 34 receives a signal, it moves the carriage 34 from the position of FIG. 3 to the position of FIG. 4 while the suction heads 38 are connected with the suction generating device 139 via conduit 39. The suction heads 38 then withdraw the foremost pocket 17 from the magazine 16 and the prime mover for the belt conveyors 40, 43 is started to advance the withdrawn pocket 17 along the path which is adjacent to the front side of the guide rail 44. If desired, the carriage 34 can return to the position of FIG. 3 even before the freshly withdrawn pocket 17 reaches the position 17*a*. The conveyor 43 is preferably operated intermittently, at least when the apparatus includes the reader 51 and/or the imprinting device 52 so that successive pockets 17 come to a halt during decoding of information by the device 51 and/or during the application of printed matter or printed labels at the station including the device 52. The manner in which the attendant who is seated in front of the table 2 introduces assemblies 21 into the related pockets 17 (at the filling station 45) and removes the filled and closed pockets has been described above.

The devices 18, 19 and the filling station 45 can be readily designed in such a way that the apparatus can process all customary sizes and/or shapes of pockets. Pockets which can be used in the apparatus of the present invention are disclosed, for example, in the commonly owned copending application Ser. No. 885,115 filed Mar. 10, 1978 by Weber et al.

An important advantage of the improved processing apparatus is that the completion of customer orders requires a fraction of the time which is necessary to carry out such work in heretofore known apparatus. That is attributable, to a large degree, to the feature that the film sections and the related prints 105 form an assembly 21 when they advance to the location which is within reach on the table 2. Consequently, the attendant can grasp an entire assembly with one hand while the other hand maintains a pocket 17 (in the position 17*a*, i.e., at the location of the filling station 45) in an optimum condition for insertion of an entire assembly.

Another important advantage of the improved apparatus is that an attendant who is comfortably seated in front of the table 2 can examine, whenever desired, the accuracy of operation of the severing units 4 and 10 as well as the accuracy of collating means 22, i.e., whether or not film sections and prints 105 which are about to form an assembly 21 actually belong to one and the same customer. As mentioned above, an experienced or careful attendant can ascertain, at a glance, the accuracy or lack of accuracy of synchronization by the simple expedient of comparing the motifs of one or more film frames in front of the observation window 14 with the motifs of prints 105 between the monitoring device 7 and the cutting device 8. Such observation can be carried out while the attendant continues to complete customer orders, i.e., during introduction of assemblies 21 which are withdrawn from the tray 20 into pockets 17 which are held by the retaining device at the filling station 45. It is clear that the apparatus further comprises suitable controls (e.g., pushbuttons or levers on a control panel) which are within reach so that the attendant can arrest the apparatus or can carry out necessary adjustments when the visual inspection reveals the absence of synchronization or another defect.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for processing webs of exposed and developed customer films and webs of photosensitive material including prints of the images of film frames of customer films, comprising first severing means for severing the webs of successive customer films so that each film yields a set of sections; second severing means for severing the webs of photosensitive material so that such webs yield discrete prints; means for collating sets of film sections and the related prints to form assemblies each including a set of film sections and the related prints, said collating means including means for delivering successive assemblies to a first location; a magazine for empty pockets bearing information which identifies the corresponding customer films; and means for transporting successive empty pockets from said magazine to a second location, said first and second locations being respectively within reach of one hand and the other hand of an attendant in charge of introducing successively formed assemblies into successive pockets which are transported to said second location.

2. Apparatus as defined in claim 1, further comprising a table, said locations being disposed at the opposite sides of said table and said severing means being located behind said table and including guide means for guiding the web of films and the web of photosensitive material in substantial parallelism with each other from one of said sides toward the other of said sides of said table.

3. Apparatus as defined in claim 2, wherein the guide means of one of said severing means is arranged to guide the respective web in a plane which slopes downwardly and forwardly toward said table.

4. Apparatus as defined in claim 3, wherein said guide means of said one severing means is the guide means of said second severing means.

5. Apparatus as defined in claim 2, further comprising a container for successive assemblies disposed at said first location; and wherein said collating means includes conveyor means for advancing severed prints along a first path, means for distributing the prints leaving said first path according to quality, and means for conveying satisfactory prints from said distributing means to said container.

6. Apparatus as defined in claim 5, wherein said collating means further comprises a source of empty envelopes, means for conveying empty envelopes to said first severing means for introduction of sets of film sections thereinto, and means for conveying filled envelopes into said container.

7. Apparatus as defined in claim 6, wherein said conveying means comprise endless flexible elements.

8. Apparatus as defined in claim 6, wherein said conveying means comprise pairs of rolls.

9. Apparatus as defined in claim 6, wherein said conveying means include a chute.

10. Apparatus as defined in claim 1, further comprising singularizing means interposed between said magazine and said transporting means and including means for transferring pockets seriatim from said magazine to said transporting means.

11. Apparatus as defined in claim 10, wherein said second location is a filling station and said transporting means has a discharge end at said filling station.

12. Apparatus as defined in claim 10, further comprising suction-operated pocket retaining means at said second location.

13. Apparatus as defined in claim 12 for introducing assemblies into pockets of the type having a rear panel and a front panel movable with respect to said rear panel, said retaining means including means for attracting the rear panels of pockets which said transporting means delivers to said second location.

14. Apparatus as defined in claim 12, further comprising means for actuating said singularizing means, said transporting means and said retaining means in synchronism with the operation of said severing means.

15. Apparatus as defined in claim 1 for introducing assemblies of film sections and prints into pockets having information encoded thereon, wherein said transporting means is operative for transporting the pockets parts means for decoding such information situated intermediate said magazine and said second location.

16. Apparatus as defined in claim 1, wherein said transporting means is operative for transporting the pockets past means for applying data to the pockets situated intermediate said magazine and said second location.

* * * * *